US010895405B2

(12) United States Patent
Mahajan et al.

(10) Patent No.: US 10,895,405 B2
(45) Date of Patent: Jan. 19, 2021

(54) TANKLESS WATER HEATER APPARATUS, SYSTEM, AND METHODS

(71) Applicant: Rheem Manufacturing Company, Atlanta, GA (US)

(72) Inventors: Govinda Mahajan, Montgomery, AL (US); Edward Turner, Anniston, AL (US); Frank Haslbauer, Prattville, AL (US); Seth Joshua Prince, Sellersburg, IN (US)

(73) Assignee: Rheem Manufacturing Company, Atlanta, GA (US)

( * ) Notice: Subject to any disclaimer, the term of this patent is extended or adjusted under 35 U.S.C. 154(b) by 151 days.

(21) Appl. No.: 16/141,713

(22) Filed: Sep. 25, 2018

(65) Prior Publication Data

US 2020/0096233 A1 Mar. 26, 2020

(51) Int. Cl.

| | |
|---|---|
| ***F22B 27/00*** | (2006.01) |
| ***F22B 35/00*** | (2006.01) |
| ***F24H 9/20*** | (2006.01) |
| ***F24H 9/14*** | (2006.01) |
| ***F24H 1/14*** | (2006.01) |

(52) U.S. Cl.

CPC ..... *F24H 9/2035* (2013.01); *F24H 1/145* (2013.01); *F24H 9/146* (2013.01)

(58) Field of Classification Search

CPC ..... F24H 1/10; F24H 1/20; F28F 1/22; F28F 1/32; F22B 27/00; F22B 35/005; F28D 1/05308; F28D 1/05358; F28D 1/05366; F28D 1/05316; F28D 1/05391; F28D 7/16

See application file for complete search history.

(56) References Cited

U.S. PATENT DOCUMENTS

| | | | | |
|---|---|---|---|---|
| 3,349,755 | A * | 10/1967 | Miller | F24H 1/145 122/13.3 |
| 3,543,731 | A * | 12/1970 | David | F24H 1/52 122/33 |
| 4,738,309 | A * | 4/1988 | Schilling | F28F 1/32 165/144 |
| 7,046,922 | B1 | 5/2006 | Sturm et al. | |
| 8,787,742 | B2 * | 7/2014 | Lutz | F24H 1/102 392/449 |
| 9,341,391 | B2 * | 5/2016 | Stebbins | F24H 9/2028 |
| 9,574,792 | B2 * | 2/2017 | Lutz, II | F24H 1/102 |
| 9,618,230 | B2 * | 4/2017 | Liu | F24H 1/121 |
| 2010/0086289 | A1 * | 4/2010 | Johnson | F24H 9/2028 392/490 |

(Continued)

*Primary Examiner* — Gregory A Wilson

(74) *Attorney, Agent, or Firm* — Troutman Pepper Hamilton Sanders LLP

(57) ABSTRACT

The present disclosure is directed to a tankless water heater and systems and methods of using the same. The tankless water heater embodiments of the present disclosure can be configured to have a plurality of independently operable heat exchangers that can be used individually or collectively, in any combination, to heat water based on the level of demand for hot water. Embodiments can be configured for randomly selecting which heat exchangers are used to heat the incoming water. Embodiments of the present disclosure can also be configured to flow water through heat exchangers that are not being used to heat water and direct such water to a recirculation loop.

19 Claims, 6 Drawing Sheets

(56) References Cited

U.S. PATENT DOCUMENTS

2013/0175016 A1* 7/2013 Steele ..... F28F 1/00
165/175
2014/0326197 A1* 11/2014 Deivasigamani ..... F24H 1/285
122/18.4

* cited by examiner

TANKLESS WATER HEATER APPARATUS, SYSTEM, AND METHODS

TECHNICAL FIELD

Embodiments of the technology relate generally to tankless water heater systems and methods of using the same.

BACKGROUND

The present disclosure relates generally to the field of tankless water heaters. Tankless water heaters, in a residential setting, are compact units that provide hot water on demand, without storing it as traditional tank-type water heaters do. When a hot water tap is turned on, cold water enters the unit from the water supply. A sensor detects the water flow and activates a heating device. A gas-fired tankless water heater uses a gas burner as the source of heat and a heat exchanger assembly that efficiently transfers the heat energy from the fuel source to a small volume of water that is flowing through the water heater. When there is no longer a demand (e.g., water flow from the fixture or appliance stops), the burner shuts off. Tankless water heaters significantly reduce standby losses, which makes them an energy-efficient alternative to traditional water heaters.

Tankless water heaters have a risk of corrosion from scaling—scale and lime from calcium and other minerals in the water supply that build up in the copper heat exchanger inside the unit. Although scaling also occurs in tank-type water heaters, the scaling builds up at the bottom of the tank and has much less effect on the water flow and tank performance than with a tankless water heater. Scale in a tankless water heater can restrict or block the flow of water through a heat exchanger and diminish the life of the unit.

The foregoing background information is provided to reveal information believed by the applicant to be of possible relevance to the present disclosure. No admission is necessarily intended, nor should be construed, that any of the preceding information constitutes prior art against the present disclosure.

SUMMARY

The present disclosure is related to a tankless water heater and system and methods of using the same. Embodiments within the scope of the present disclosure can facilitate improving the longevity of the heat exchanger and/or reduce the cost of maintenance as compared to prior designs. Embodiments within the scope of the present disclosure can facilitate more efficient heating of water as compared to prior designs.

In one aspect, the present disclosure relates to a heat exchanger for a tankless water heater comprising: an inlet manifold comprising an inlet port; an outlet manifold comprising an outlet port; a plurality of conduits, each of the plurality of conduits comprising a first valve and defining a flow path between the inlet manifold and the outlet manifold, wherein each conduit of the plurality of conduits is associated with an inlet conduit port of the inlet manifold and an outlet conduit port of the outlet manifold; and a controller configured to actuate each of the first valves as determined by the level of demand for heated water such that an increasing number of valves of the first plurality of valves are actuated to allow fluid flow as the level of demand for heated water increases.

In a second aspect of the present disclosure, the present disclosure relates to a heat exchanger for a tankless water heater comprising: an inlet manifold comprising an inlet port and an inlet recirculation port; an outlet manifold comprising an outlet port; a recirculation manifold that is in fluid communication with the inlet recirculation port; a plurality of conduits, each conduit of the plurality of conduits defining a flow path between the inlet manifold and the outlet manifold, wherein each conduit of the plurality of conduits is associated with an inlet conduit port of the inlet manifold and an outlet conduit port of the outlet manifold, and wherein the recirculation manifold comprises a recirculation conduit port for all of the plurality of conduits and is configured such that each recirculation conduit port can be in fluid communication and associated with only one of the plurality of conduits; and a first plurality of valves, one each being in fluid communication with the recirculation manifold and one of the plurality of conduits, wherein each valve is configured to direct fluid to either the outlet manifold or the recirculation manifold.

In another aspect, the disclosure relates to control systems for managing multiple heat exchangers within tankless water system as described herein.

In yet another aspect, the disclosure relates to a method of using the tankless water heaters as described herein. Such methods can comprise allowing cold water to flow from a cold water supply into an input manifold; actuating a valve so that water flows through an input manifold through one or more conduits and into an outlet manifold; and actuating a valve so that water flows through the input manifold through one or more conduits, through a recirculation manifold, and into the input manifold to mix with the cold water, wherein the water flowing into the outlet manifold is heated water and the water flowing through the recirculation manifold is at a temperature lower than that of the heated water.

These and other aspects will be described further in the example embodiments set forth herein.

BRIEF DESCRIPTION OF THE FIGURES

The foregoing and other features and aspects of the present disclosure are best understood with reference to the following description of certain example embodiments, when read in conjunction with the accompanying drawings, wherein.

Figure 1:
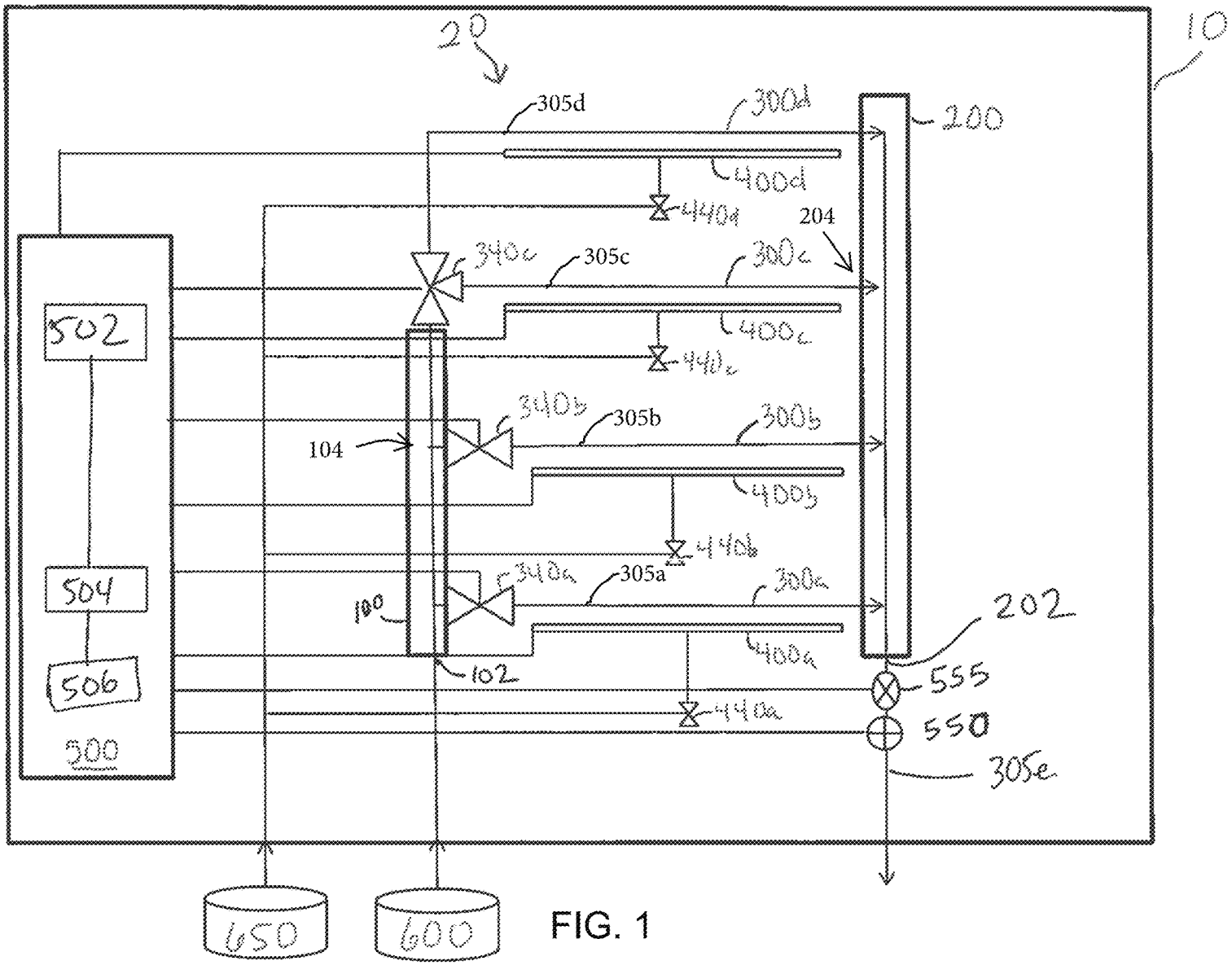
FIG. 1 is a schematic of an embodiment of a control system of a tankless water heater.

The drawings illustrate only example embodiments of the present disclosure and are therefore not to be considered limiting of its scope, as the present disclosure may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles.

In the foregoing figures showing example embodiments of tankless water heaters and control systems thereof, one or more of the components shown may be omitted, repeated, and/or substituted. Accordingly, the example embodiments of tankless water heaters and control systems thereof should not be considered limited to the specific arrangements of components shown in any of the figures. For example, features shown in one or more figures or described with respect to one embodiment can be applied to another embodiment associated with a different figure or description.

DETAILED DESCRIPTION OF EXAMPLE EMBODIMENTS

The present disclosure is directed to a tankless water heater and systems and methods of using the same. The tankless water heater embodiments of the present disclosure can be configured to have a plurality of independently operable heat exchangers that can be used individually or collectively, in any combination, to heat water based on the level of demand for hot water. Embodiments can be configured for selecting which heat exchangers are used to heat the incoming water, wherein the selection can be random or can be based on data such as past usage or performance of particular heat exchanger components. Embodiments of the present disclosure can also be configured to flow water through heat exchangers that are not being used to heat water and direct such water to a recirculation loop. Embodiments can be configured for maintaining operation even if one or more of the heat exchangers becomes inoperable provided that not all are inoperable. Embodiments within the scope of the present disclosure can facilitate more efficient heating of water as the recirculation loops can absorb some heat that might otherwise be wasted. Embodiments within the scope of the present disclosure can facilitate reducing the amount of scale build up over a given period of time as compared with current tankless designs and may improve the longevity of the heat exchanger and/or reduce the cost of maintenance.

Some representative embodiments will be described more fully hereinafter with example reference to the accompanying drawings that illustrate embodiments of the disclosure. The disclosure may, however, be embodied in many different forms and should not be construed as limited to the embodiments set forth herein; rather, these embodiments are provided so that this disclosure will be thorough and complete, and will fully convey the scope of the disclosure to those appropriately skilled in the art.

Turning now to the figures, FIG. 1 depicts a schematic of a tankless water heater 10 comprising an embodiment of a heat exchanger 20 in accordance with the present disclosure. The heat exchanger 20 comprises an inlet manifold 100; an outlet manifold 200; a plurality of conduits 300*a* to 300*d* (collectively, referred to as conduits 300) defining a flow path 305*a* to 305*d* (collectively, referred to as flow path 305) between the inlet manifold and the outlet manifold; a plurality of valves 340*a* to 340*d* (collectively, referred to as valves 340), one each associated with each of the plurality of conduits 300; a plurality of burner elements 400*a* to 400*d* (collectively, referred to as burner elements 400) configured so that a single burner element 400 is intended to heat a single section of conduit 300.

Figure 2:
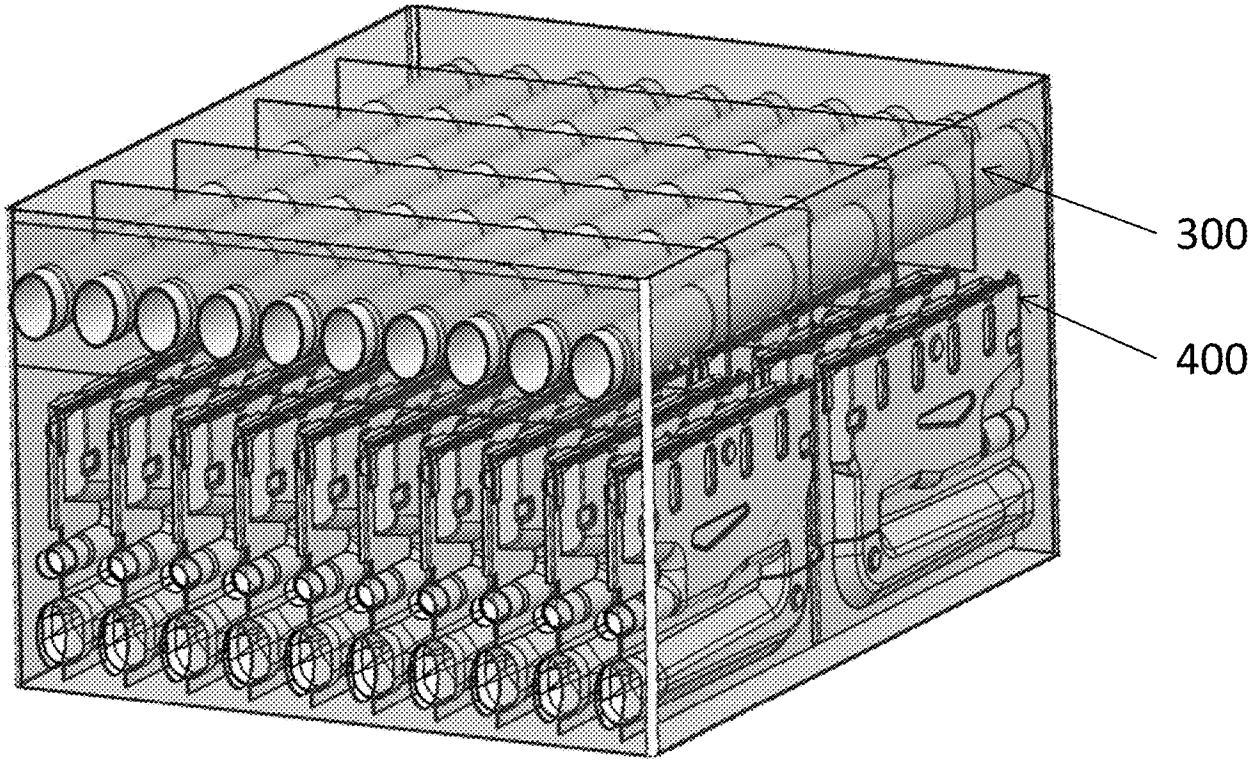
FIG. 2 illustrates an isolated view of burner elements and conduits of a tankless water heater embodiment in accordance with the present disclosure.

The inlet manifold 100 comprises an inlet port 102 configured to couple with a cold water supply 600 (FIG. 2). The inlet manifold 100 also comprises a conduit inlet port (e.g., conduit inlet port 104) for every conduit 300. Through the conduit port 104, the conduit 300 can be in fluid communication with the inlet manifold 100.

Similarly, the outlet manifold 200 comprises an outlet port 202 configured to couple to a hot water supply plumbing system. The outlet manifold 200 also comprises a conduit outlet port (e.g., conduit outlet port 204) for every conduit 300. Through the conduit outlet port 204, the conduit 300 can be in fluid communication with the outlet manifold 200.

The plurality of conduits 300 define a plurality of flow paths 305*a* to 305*d* that extend between the inlet manifold 100 and the outlet manifold 200. While the current embodiment depicts four conduits 300, it is understood that any number of conduits 300 suitable for the estimated demand maximums can be used, such as 2, 3, 4, 5, 6, 7, 8, 9, 10, 11, 12, 13, 14, 15, 16, 17, 18, 19, 20, or more conduits. The conduits are comprised of a heat conductive material such as materials comprising or consisting of copper or aluminum. The conduits 300 are configured in size and shape to facilitate the rapid heating of the water passing therein that is required to meet the desired temperature and desired output flow rate. In some embodiments, the inner diameter of each conduit 300 can be selected for 0.4 gpm to 0.8 gpm with a flow velocity between 0.5 m/s and 6 m/s, e.g., 0.5 m/s to 2 m/s, 2 m/s to 4 m/s, or 4 m/s to 6 m/s. In some embodiments, the inner diameter of each conduit 300 can be 4 mm to 10 mm, e.g., 4 mm to 6 mm, 6 mm to 7 mm, 7 mm to 8 mm, or 8 mm to 10 mm. In some embodiments, the length of the conduit can be between 2 cm and 50 cm. It is understood that these variables depend on the capacity of the heater 10.

The burner elements 400 can have a shape suitable for disposing in-line with the conduit 300 to facilitate heating the conduit along its length and ultimately to facilitate the required rate of heating of the conduit. In the embodiment shown, burner element 400 is a burner strip and conduit 300 is a straight tube. The burner element 400 is intended to heat a particular conduit 300 and is generally parallel or aligned with that conduit. FIG. 2 illustrates this parallel relationship between burner elements 400 and conduits 300. In the embodiment shown in FIG. 2, conduits 300 are in a 1×10 configuration (also referred to as a single stack configuration) and the plurality of conduits 300 are in the same 1×10 configuration and situated adjacent to and aligned with the burner elements 400. The burner elements 400 are configured to apply sufficient heat to the conduit 300 to facilitate the rapid heating of the water passing therein that is required to meet the desired temperature and desired output flow rate. In some embodiments, an individual burner element 400 is configured to produce 1300 btus to 11000 btus.

Burner elements 400 are configured to be coupled to a fuel source 650. Burner elements can be in communication with the fuel source via a valve 440*a* to 440*d* (collectively referred to as valve 440).

Valves 340 can be 2-way valves or a combination of 2-way valves and 3-way valves. For example, the embodiment depicted in FIG. 1 described below comprises a combination of 2-way valves 340*a* and 340*b* and one 3-way valve 340*c* which controls flow to two conduits 300*c* and 300*d*. A 3-way valve at 340*c* is configured to direct fluid to conduit 300*c* only, conduit 300*d* only, or both conduits 300*c* and 300*d* and to block fluid to both conduits 300*c* and 300*d*. Valves 440 can be 2-way valves.

The actuatable components, namely, the valves 340, 440 and burner elements 400, comprise an automated actuator. For example, valves 340, 440 are configured to be actuated via a solenoid. Similarly, burner elements 400 are configured to be actuated via a control switch.

The tankless water heater 10 can also comprise one or more sensors in communication with the flow path 305 to measure one or more physical variables of the water flowing through the tankless water heater. Such sensors can include at least one temperature sensor 550, which can be configured to measure the temperature of the heated water or configured to measure the temperature of the water from the cold water supply or the water within the inlet manifold 100. To facilitate determining the level of demand for heated water, a sensor can comprise a flow rate sensor or pressure sensor 555 in fluid communication with the outlet port 202. One or more pressure sensors or flow rate sensors can be in fluid communication with each of the plurality of conduits to assist in the determination of conduit operability or performance level on an individualized basis. Such sensors can be useful for identifying whether there is scale build up within the system.

FIG. 1 further depicts a control system of the tankless water heater 10. The control system comprises a controller 500; a flow rate sensor or pressure sensor 555 disposed within a flow path 305*e* downstream of the plurality of conduits 300 and electrically coupled to the controller 500; a temperature sensor 550 also disposed within a flow path 305*e* downstream of the plurality of conduits 300 and electrically coupled to the controller 500; at least one control switch operably coupled to the controller and configured to actuate the plurality of burner elements individually; and a valve actuator for each of the valves 340, 440 operably coupled to the controller.

Those skilled in the art should be familiar with the use of controllers in devices like a tankless water heater that comprise integrated sensors and automated actuators that are actuated by the controller based on the input from the sensors and predefined instructions stored in the controller. Controller 500 may be implemented in software, firmware, hardware, or some suitable combination of at least two of the three. Controller 500 is configured to receive and process input from the sensors 555, 550 and to transmit signals to actuate the various valves 340, 440 and burner elements 400. Controller 500 can also be configured to send a signal requesting input from a sensor (e.g., sensors 555, 550). Controller 500 can comprise a data signal transmitter/receiver 502 configured to be directly or indirectly joined, united, or linked, such as through circuitry or a wireless connection, to the automated actuators and sensors described herein. Controller 500 can comprise a central processing unit (CPU) 504 and a memory 506 storing an instruction module that is configured to process the input from the sensors 555, 550 to determine which valves 340, 440 and burner elements 400 are to be actuated. Controller 500 is configured to send a signal that triggers the automated actuators of the burner elements 400 and valves 340, 440 to actuate in accordance with the signal.

Controller 500 is configured to actuate each of the valves 340 determined, in part, by a level of demand for heated water such that an increasing number of valves 340 of the plurality of first valves 340 are actuated to allow fluid flow as the level of demand for heated water increases. Similarly, controller 500 is configured to actuate each of the valves 440 of the plurality of burner valves 440 determined, in part, by the level of demand for heated water such that an increasing number of valves 440 of the plurality of valves 440 are actuated to allow fuel flow to the burner element 400 as the level of demand for heated water increases. Controller 500 can be configured to determine the level of demand for heated water based upon the input from the flow rate or pressure sensor 555. The instruction module is configured to determine how many conduits 300 need to be heating water to meet the level of demand.

Controller 500 can be configured to randomly select which heat exchanger flow path 305 to use for heating. For example, controller 500 can be configured to randomly select which valve(s) 340 and associated burner element(s) 400 to actuate when only a portion of conduits 300 are determined to be needed to heat water based upon the level of demand for heated water.

Controller 500 can be configured to take a conduit 300 and associated burner element 400 offline if inoperable or poorly functioning and only operate with the remaining conduits 300. One or more sensors, e.g., a temperature, pressure, and/or flow rate sensor (not shown), in fluid communication with each of the plurality of conduits to assist in the determination of conduit operability or performance level on an individualized basis can be coupled to controller 500. Such sensors can be useful for alerting an owner or technician that there might be significant scale build up within a specific conduit 300.

Figure 3:
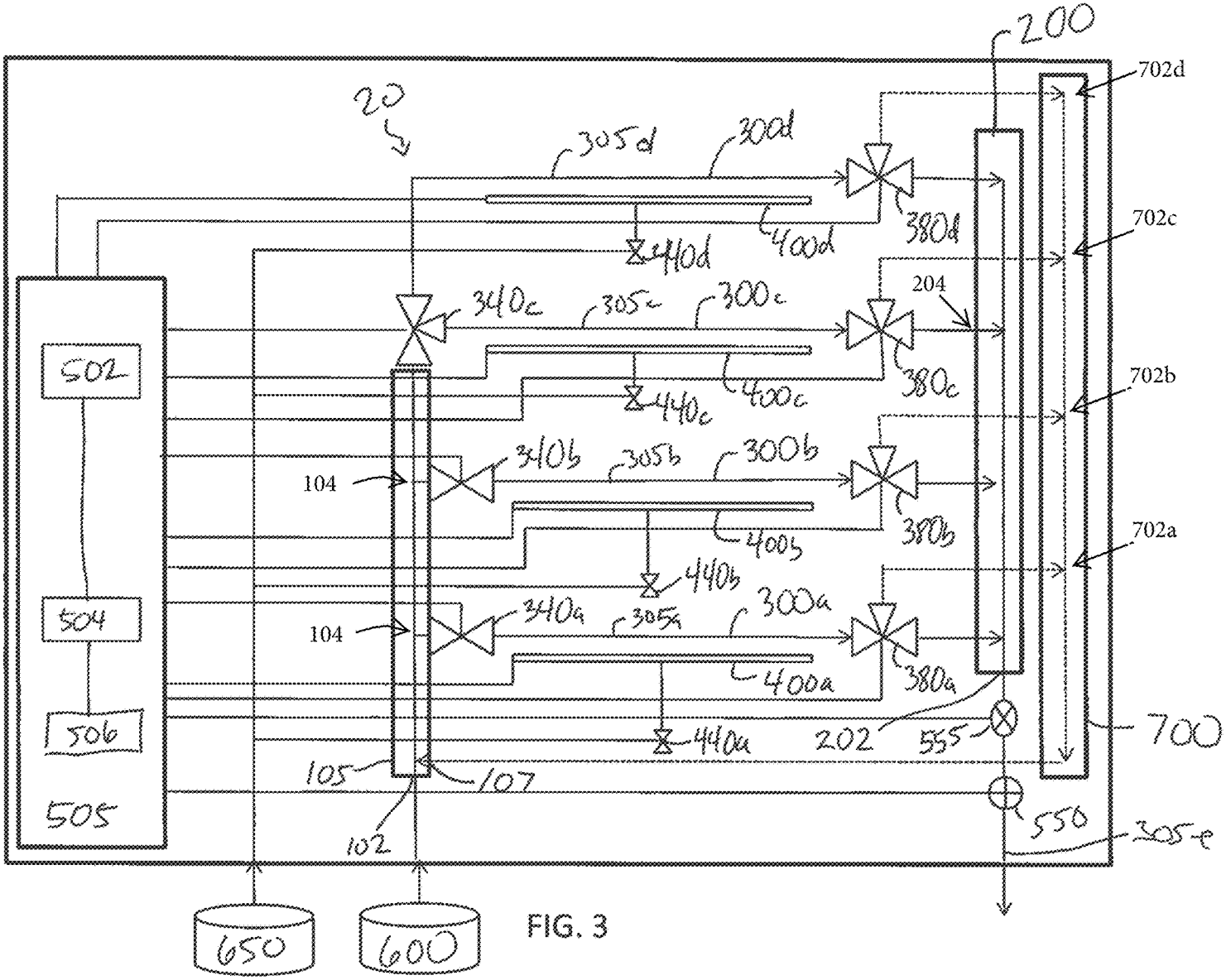
FIG. 3 is a schematic of an embodiment of a control system of a tankless water heater like that in FIG. 1 but further configured to have a recirculation loop.

FIG. 3 depicts a schematic of a control system of a tankless water heater like tankless water heater 10 illustrated in FIG. 1 but one that is further configured to have a recirculation loop. The control system shown in FIG. 3 includes all the elements and functions described in association with FIG. 2 and further comprises a recirculation manifold 700; an inlet manifold 105, which is identical to that of inlet manifold 100 except that it also comprises an inlet recirculation port 107 that is in fluid communication with the recirculation manifold 700; a plurality of second valves 380*a* to 380*d* (collectively referred to herein as second valve 380); and a controller 505, which is identical to controller 505 except that it comprises additional capabilities for managing the recirculation loop and controlling the valves 380 associated therewith, as further described below.

The recirculation manifold 700 comprises a recirculation conduit port 702*a* to 702*d* (collectively referred to here as recirculation conduit port 702) for all or a portion of the plurality of conduits 300 and is configured such that each recirculation conduit port 702 can be in fluid communication and associated with only one of the plurality of conduits 300. The recirculation manifold 700 is configured to be in fluid communication with the inlet recirculation port 107 of the inlet manifold 105.

Each of the plurality of second valves 380 are in fluid communication with the recirculation manifold 700 and one of the plurality of conduits 300. Each valve 380 is configured to direct fluid to either the outlet manifold 200 or the recirculation manifold 700. Valves 380 can be 3-way valves. Valves 380 can be configured to be actuated via an automated actuator, such as a solenoid.

Controller 505 can also be configured to actuate each valve of the plurality of second valves 380 determined by the level of demand for heated water such that an increasing number of valves 380 will direct fluid to the outlet manifold 200 as the level of demand for heated water increases. For example, controller 505 can be configured such that if a burner element 400 associated with (or nearest to) a particular conduit 300 is actuated, the valve 380 associated with that conduit 300 is also actuated to direct fluid to the outlet manifold 200.

In some embodiments, controller 505 can be configured such that if a valve 380 associated with a particular conduit 300 is actuated to direct fluid to the recirculation manifold 700, the burner element 400 associated with (or nearest to) that conduit 300 or valve 380 is not actuated.

Figure 4A:
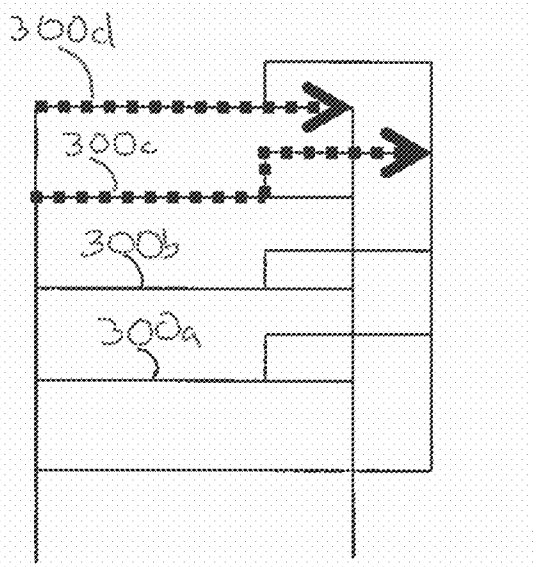
FIGS. 4A to 4H are schematics of example patterns of flow that are possible with the embodiment shown in FIG. 3 at different levels of demand for heated water.
Figure 4B:
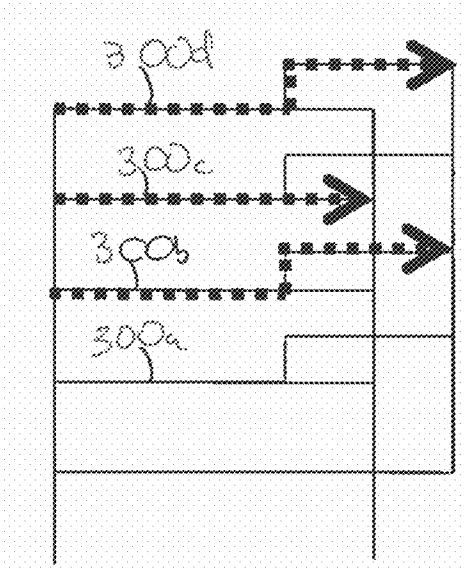
Figure 4C:
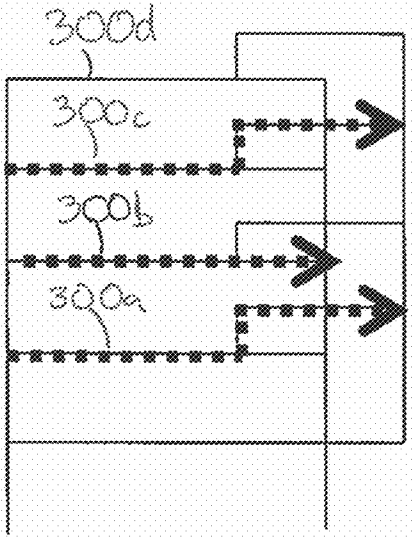
Figure 4D:
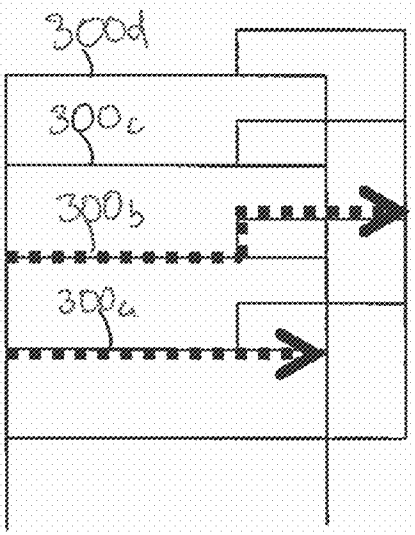
Figure 4E:
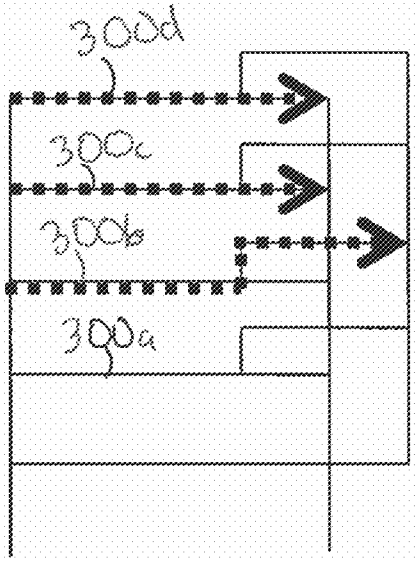
Figure 4F:
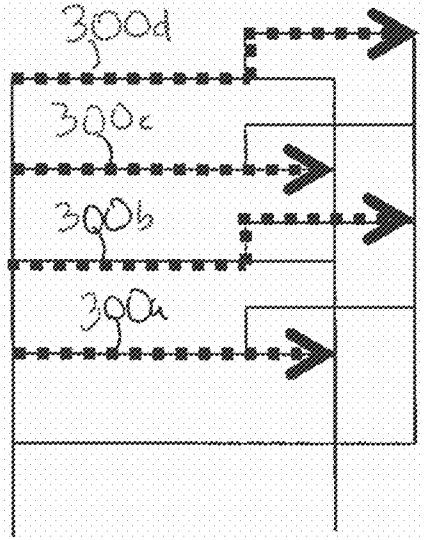
Figure 4G:
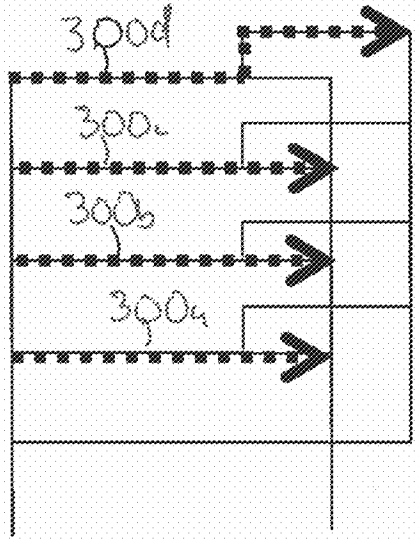
Figure 4H:
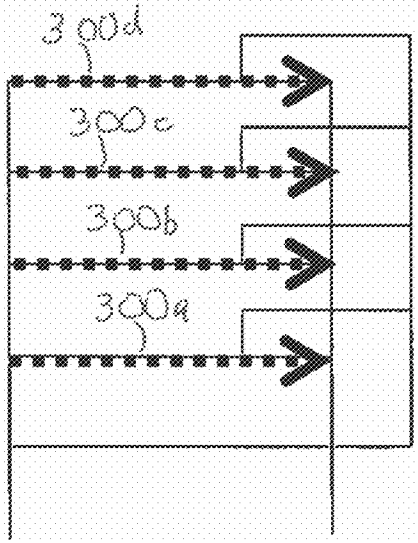

Like in controller 500, controller 505 can be configured to randomly select which heat exchanger flow path 305 to use for heating. Alternatively, the controller 505 can select heat exchanger flow paths based on prior usage or performance data. The conduits flanking the conduit(s) 300 being heated will have water flowing through them that is directed to the recirculation manifold 700 and ultimately back to the inlet manifold 105. Examples of various flow patterns at 25%, 50%, 75%, and 100% demand level are depicted in FIGS. 4A to 4H. As shown in FIGS. 4A to 4H, broken lines indicate flow paths with water flowing, whereas conduits without broken lines indicate no water is flowing. In the case flow paths with water flowing, the broken lines indicate whether water is flowing to the outlet manifold (and therefore is heated) or the water is being directed to recirculation manifold by a valve. The examples provided in FIGS. 4A to 4H do not illustrate all possible patterns but only a few for purposes of demonstration. FIGS. 4A to 4D illustrate flow patterns if the demand level only requires a single conduit 300 to be heated. By way of example, FIG. 4A has conduit 300*d* being heated and directed to the outlet manifold 200 and conduit 300*c* being directed to the recirculation manifold 700. FIGS. 4E and 4F illustrate flow patterns if the demand level required two conduits to be heated. FIG. 4G illustrates a flow pattern if the demand level required three conduits to be heated. FIG. 4H illustrates a flow pattern if the demand level required all four conduits to be heated.

Figure 5:
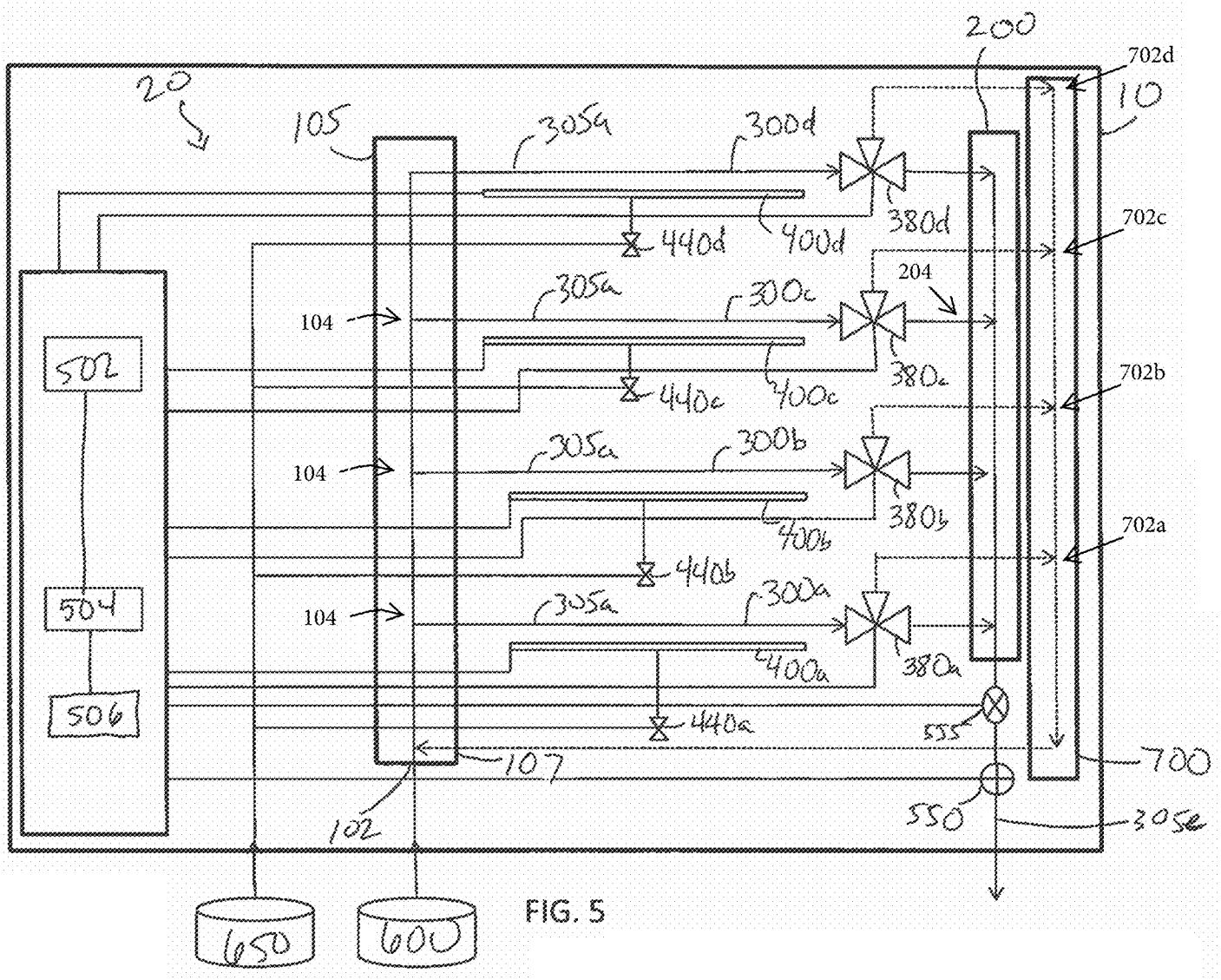
FIG. 5 is a schematic of an embodiment of a control system of a tankless water heater like that in FIG. 3 except that this embodiment does not include a set of valves between the inlet manifold and the heat exchanging conduits.

FIG. 5 depicts a schematic of a control system of a tankless water heater like the system illustrated in FIG. 3 but one that does not have valves 340. The control system shown in FIG. 5 otherwise includes all the elements and functions described in association with FIG. 3.

Other embodiments of the present disclosure include methods of heating water with the above described tankless water heaters and control systems. A method of heating water can comprise allowing cold water to flow from a cold water supply into a input manifold 105; actuating a valve 340 so that water flows through an input manifold 105 through one or more conduits 300 and into an outlet manifold 200; and actuating a valve 380 so that water flows through the input manifold 100 through one or more conduits 300, through a recirculation manifold 700, and into the input manifold 105 to mix with the cold water, wherein the water flowing into the outlet manifold 200 is heated water and the water flowing through the recirculation manifold 700 is at a temperature lower than that of the heated water.

Other methods can comprise randomly selecting which valve 340 and/or 380 and burner element 400 pairing to actuate for heating water.

Many modifications and other embodiments of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A heat exchanger for a tankless water heater comprising:

an inlet manifold comprising an inlet port and an inlet recirculation port;

an outlet manifold comprising an outlet port;

a plurality of conduits, each of the plurality of conduits comprising a first valve and defining a flow path between the inlet manifold and the outlet manifold, wherein each conduit of the plurality of conduits is associated with an inlet conduit port of the inlet manifold and an outlet conduit port of the outlet manifold;

a recirculation manifold in fluid communication with the inlet recirculation port; and a controller configured to actuate each of the first valves determined by a level of demand for heated water such that an increasing number of valves of the first valves are actuated to allow fluid flow as the level of demand for heated water increases.

2. The heat exchanger of claim 1, further comprising a sensor disposed within a flow path downstream of the plurality of conduits and electrically coupled to the controller, wherein the controller is configured to determine the level of demand for heated water based upon the input from the sensor.

3. The heat exchanger of claim 1, wherein the recirculation manifold comprises a recirculation conduit port for all except one of the plurality of conduits and is configured such that each recirculation conduit port can be in fluid communication and associated with only one of the plurality of conduits.

4. The heat exchanger of claim 3, further comprising a plurality of second valves, one of the plurality of second valves each being in fluid communication with the recirculation manifold and one of the plurality of conduits and wherein each valve is configured to direct fluid to either the outlet manifold or the recirculation manifold.

5. The heat exchanger of claim 4, wherein the controller is configured to actuate each valve of the plurality of second valves determined by the level of demand for heated water such that an increasing number of valves of the plurality of second valves will direct fluid to the outlet manifold as the level of demand for heated water increases.

6. The heat exchanger of claim 1, further comprising a plurality of burner elements, one each associated and parallel with each of the plurality of conduits and comprising at least one control switch configured to actuate the plurality of burner elements individually, wherein the at least one control switch is operably coupled to the controller.

7. The heat exchanger of claim 6, wherein the plurality of burner elements are in a single stack configuration and the plurality of conduits are in a single stack configuration.

8. The heat exchanger of claim 6, wherein the controller is configured such that if one of the first valves is actuated to allow fluid flow, a burner element is actuated that is nearest the conduit associated with the first valve that is actuated.

9. The heat exchanger of claim 6, wherein the controller is configured such that if a valve of a plurality of second valves is actuated to direct fluid to the outlet manifold, a burner element is actuated that is nearest the conduit associated with the second valve that is actuated.

10. The heat exchanger of claim 9, wherein the controller is configured such that if a valve of the plurality of second valves is actuated to direct fluid to the recirculation manifold, the burner element nearest the conduit associated with that second valve is not actuated.

11. The heat exchanger of claim 1, wherein the controller is configured to randomly select a valve of the first valves to allow flow when only a portion of the first valves are determined to be needed to allow flow based upon the level of demand for heated water.

12. A heat exchanger for a tankless water heater comprising an inlet manifold comprising an inlet port and an inlet recirculation port;

an outlet manifold comprising an outlet port;

a recirculation manifold that is in fluid communication with the inlet recirculation port;

a plurality of conduits, each conduit of the plurality of conduits defining a flow path between the inlet manifold and the outlet manifold, wherein each conduit of the plurality of conduits is associated with an inlet conduit port of the inlet manifold and an outlet conduit port of the outlet manifold, and wherein the recirculation manifold comprises a recirculation conduit port for all of the plurality of conduits and is configured such that each recirculation conduit port can be in fluid communication and associated with only one of the plurality of conduits; and a first plurality of valves, each valve of the first plurality of valves being in fluid communication with the recirculation manifold and one of the plurality of conduits and wherein each valve of the first plurality of valves is configured to direct fluid to either the outlet manifold or the recirculation manifold.

13. The heat exchanger of claim 12, further comprising a controller configured to actuate each valve of the first plurality of valves determined by a level of demand for heated water such that an increasing number of valves of the first plurality of valves are actuated to direct fluid to the outlet manifold as the level of demand for heated water increases.

14. The heat exchanger of claim 13, further comprising a pressure sensor disposed within a flow path downstream of the plurality of conduits and electrically coupled to the controller, wherein the controller is configured to determine the level of demand for heated water based upon an input from the pressure sensor.

15. The heat exchanger of claim 14, further comprising a plurality of burner elements, one each associated and parallel with each of the plurality of conduits and comprising at least one control switch configured to actuate the plurality of burner elements individually, wherein the at least one control switch is operably coupled to the controller.

16. The heat exchanger of claim 15, wherein the controller is configured such that if a valve of the first plurality of valves is actuated to direct flow to the outlet manifold, a burner element is actuated that is nearest the conduit associated with the valve of the first plurality of valves that is actuated.

17. The heat exchanger of claim 15, wherein the controller is configured such that if a valve of the first plurality of valves is actuated to direct fluid to the recirculation manifold, the burner element is actuated that is nearest the conduit associated with the valve of the first plurality of valves that is not actuated.

18. The heat exchanger of claim 12, wherein the controller is configured to randomly select a valve of the first plurality of valves to direct flow to the outlet manifold when only a portion of the first plurality of valves are determined to be needed to direct flow to the outlet manifold based upon a level of demand for heated water.

19. A method of heating water in a heat exchanger comprising:

allowing cold water to flow from a cold water supply into a input manifold;

actuating a first valve so that water flows through an input manifold through one or more conduits and into an outlet manifold; and actuating a second valve so that water flows through the input manifold through one or more conduits, through a recirculation manifold, and into the input manifold to mix with the cold water, wherein the water flowing into the outlet manifold is heated water and the water flowing through the recirculation manifold is at a temperature lower than that of the heated water.

* * * * *